United States Patent [19]

Clifton et al.

[11] 4,214,033

[45] Jul. 22, 1980

[54] NOVEL MESH FABRIC AND WIG AND HAIR-PIECE MADE THEREFROM

[75] Inventors: John D. Clifton, 50 Elgin Crescent, London W 11, England; Victor W. Titow, Stoke Poges, England

[73] Assignee: John David Clifton, London, England

[21] Appl. No.: 842,328

[22] Filed: Oct. 14, 1977

[30] Foreign Application Priority Data

Oct. 18, 1976 [GB] United Kingdom ..... 43129/76
Apr. 12, 1977 [GB] United Kingdom ..... 14987/77

[51] Int. Cl.[2] ..... D03D 9/00

[52] U.S. Cl. ..... 428/255; 132/53; 428/267

[58] Field of Search ..... 132/5, 53; 428/105, 428/107, 108, 131, 137, 247, 253, 254, 255, 268, 337, 267

[56] References Cited

U.S. PATENT DOCUMENTS

| | | | |
|---|---|---|---|
| 2,491,454 | 12/1949 | Nute | 418/255 |
| 2,519,474 | 8/1950 | Jackson | 428/255 |
| 2,530,106 | 11/1950 | Ways | 428/255 |
| 2,534,511 | 12/1950 | Frank | 428/255 |
| 2,702,764 | 2/1955 | Painter et al. | 428/255 |
| 2,874,729 | 2/1959 | Ball | 428/255 |
| 3,139,093 | 6/1964 | Frishman | 132/53 |
| 3,199,516 | 8/1965 | Frishman | 132/53 |
| 3,276,942 | 10/1966 | Ewing | 428/255 |
| 3,458,350 | 7/1969 | Barton et al. | 428/255 |

*Primary Examiner*—James J. Bell
*Attorney, Agent, or Firm*—Holman & Stern

[57] ABSTRACT

The invention provides a novel mesh fabric of increased fineness, strength and stable structure capable of substantially permanent molding into desired shapes. The invention also provides wigs and hair-pieces formed on a foundation of the novel mesh fabric.

5 Claims, No Drawings

NOVEL MESH FABRIC AND WIG AND HAIR-PIECE MADE THEREFROM

This invention relates to foundations for wigs, hair-pieces and the like, their production from mesh fabrics and to the mesh fabrics used, inter alia, for this purpose.

The term "foundation" used herein means a piece of mesh fabric corresponding in area and shape to the part of the head to which it is desired to fit a hair-piece (or, in the case of a wig, to the whole area of the head normally covered with hair) and suitable for affixing thereto human or artificial hair in order to build up a hair population of the density required in the resulting hair-piece or wig.

BACKGROUND

In the known art the desired shape is commonly imparted to fabric wig foundations by local folding and tucking. This results in small but definite local differences in the number of fabric layers and hence the thickness of the wig or hair-piece foundation. Shape conformity achievable with this construction is also not geometrically ideal. Smoother shape conformity has occasionally been obtained with a thick net fabric sometimes known as "vegetable net" by impregnating with water-soluble materials (e.g. starch) and wetting at the time of shaping on a wooden block. Apart from the coarseness of foundations so made the degree of conformity achievable in this way is comparatively low, the effect is not permanent and practicable shapes are confined to limited areas of low curvature.

It is desirable that, consistent with the required strength and hair-anchoring properties, the fabric of a wig foundation should be as fine as possible and offer the least obstruction to light, so as not to be noticeable against the scalp. This effect may be improved still further by suitable colouring of the fabric. In hair-pieces and wigs produced by the anchoring of hairs to the fabric of the foundation, the fabric should be fairly open, with a mesh size suitable for the anchoring process used, and filament strength high enough to stand up to the stresses imposed during hair-attaching operations and to those encountered in normal service. In most good-quality products that process will consist in knotting-in of the hairs; an example of a suitable mesh size for the fabric of the foundation is from 0.5 and 1 $mm^2$.

OBJECTS

It is an object of the invention to provide a wig or hair-piece foundation combining the following features:

(a) conformity to the contour of the head (or part thereof), substantially in the absence of tucks or folds, achieved by a positive moulding operation which also imparts a permanent shape to the foundation;

(b) fineness and low substance of fabric combining fine filaments or yarns with relatively large mesh sizes, the said filaments or yarns being of a strength sufficient to stand up to the stresses imposed during hair attaching operations, and to stresses in normal service;

(c) fabric construction (including mesh size) adapted to individual hair anchoring (particularly by knotting), which may permit mesh size adjustment during the final shaping of the foundation;

(d) fabric structure which may if desired, be stabilised by positive bonding between the constituent filaments or yarns, at least at some points of inter-yarn contact.

One aspect of the invention extends to the process whereby the above features are imparted to and/or combined in the wig or hair-piece foundation.

In another aspect the invention relates to a novel mesh fabric having characteristics making it particularly suitable for use as a foundation material for wigs and hair-pieces. The fabric of the invention is, by reason of its properties, suited to many other uses where fineness of fabric coupled with exceptional strength and mouldability are advantageous.

DESCRIPTION OF THE INVENTION

In some embodiments of the invention the yarns or filaments comprising the wig or hair-piece foundation will be bonded, at least at some points of intersection. If the bonding is to be carried out by heating (which may also be assisted by pressure) the yarn or filament of the wig foundation will consist of or contain suitable thermoplastic material. Filaments or yarns of interest are, for example, polyamide filaments and yarns (nylon 6 and nylon 6.6), sheath/core bicomponent types (with lower softening material as the sheath component), polyesters or linear thermoplastic polyurethane filaments. Alternatively the filament or yarn of the wig or hair-piece foundation should be amenable to a surface treatment to promote inter-yarn bonding on heating. An example of a suitable treatment is surface coating with a thermoplastic polymeric material such as a vinyl acetate copolymer, a solvent-soluble polyamide or other comparatively low-melting polymers known in the art, which may conveniently be applied to the wig or hair-piece foundation for example from solvent solution or emulsion. It will be understood that the treatment should not build up layers of the coating substance so thick as to seriously affect the thickness, mesh size and other functionally important properties of the fabric. A suitable polymeric coating of the general type mentioned may also be used to cross-bond directly the filaments or fibres of the wig or hair-piece foundations at least at some of their points of intersection, that is the bonding can take place when the coating is solidified (for example by removal of solvent) without subsequent heat activation steps.

Hair pieces are occasionally temporarily fastened to the head with the aid of soluble adhesives. It is preferable (although the feature is not cardinal to the invention) that the fabric of the hair-piece foundation according to the invention and any coating which may be applied to it as described above, should be compatible with such temporary adhesives and in particular not render the foundation unsuitable for fastening to the head in this way.

It is an important feature of the invention that the wig or hair-piece foundation can be made to conform in shape to the contour of the head or the relevant part thereof. This effect can be achieved and rendered permanent by shaping the fabric on a suitable former and then fixing it in the shaped state. Whilst some fine, rigid fabrics (i.e. ones which will not stretch appreciably when pulled with a moderate force) can be satisfactorily shaped and fixed in this way, the desired result can be particularly successfully achieved if the fabric is capable of being stretched at least to some extent, over a suitable surface reproducing in contour that of the relevant part of the head, to be subsequently fixed in the stretched state. With a substantially thermoplastic fabric the fixing may be through heat, possibly also assisted by pressure (i.e. effectively a moulding operation) or by heat setting; this could be applicable, for example when the fabric of the foundation is a nylon fabric as is at present preferred. The setting would then be a variant of the well-known process as used in the past, e.g. for setting nylon hose. The foundation may also be fixed by application and solidification in situ of a suitable polymeric coating as hereinbefore mentioned, this, if desired, being in addition to heat moulding. In the latter case the coating would fulfil the dual purpose of rendering permanent the overall imposed shape and also effecting inter-filament or inter-yarn bonding. The heat-fixing process may also serve both these purposes, or already pre-coated and/or pre-bonded fabric may be finally heat set to the desired shape.

The necessary degree of stretchability will be imparted to the fabric either by virtue of its structure (i.e. a knitted stretchable fabric) or by virtue of the elastic properties of its constituent filaments or yarns (e.g. the stretchable linear polyurethane yarn) or a suitable combination of both.

In one embodiment the present invention provides a mesh fabric particularly suitable for use in the production of the wig and/or hair-piece foundations previously referred to, in that it possesses a unique combination of fineness of filament, strength, stiffness and stretchability and the possibility of fixing by heat setting, if necessary in conjunction with the application of a suitable polymeric coating.

Accordingly, the present invention provides a novel mesh fabric formed from filaments or yarns of a synthetic material having a mean diameter of not greater than 0.11 mm, a breaking load of not less than 0.45 lbs, and a stiffness of at least 3:1 as herein defined, the fabric having a stable mesh structure as herein defined, a mesh size equal to at least twice the filament thickness, preferably a mesh size of from 6 to 14 meshes per linear cm. and a bursting strength of not less than 20 p.s.i.

The term "stiffness" as used herein refers to the rigidity of the filament or yarn and is determined by the so-called "loop test" as follows:

Two ends of a 10 cm long piece of the filament to be tested are brought together under the minimum necessary force and the following characteristics of the loop produced are measured:

(a) Distance from top centre of the loop to the point of contact of the two ends (loop length)

(b) Maximum loop width.

The value of stiffness is expressed as a ratio of a:b.

For example, in the case of one of the preferred filaments for use in the fabric of the invention, a nylon 6 monofilament with a mean diameter of 68 μm and a breaking load of between 0.500 and 0.728 lb the loop length was 3.35 cm (average of 4, maximum deviation 4%) and the loop width was 1.68 cm (average of 4, maximum deviation 7%) giving a stiffness value of 2:1.

The term "stable mesh structure" as used herein means a mesh structure in which the size and configuration of the mesh is permanent in that the filamentary elements defining and delineating the meshes are not free to slide locally over one another. Stability of the mesh structure can be attained by a suitable order of interlacing of the filamentary elements and/or by positive bonding at the relevant contact points of the elements. It will be understood that if the fabric itself is stretchable (e.g. by virtue of its design), then the meshes may be distorted where the particular area of the fabric has been stretched but they will still remain stable in the sense just defined.

The bursting strength of the fabric of the invention is measured in accordance with the method of British Standard Handbook No. 11, using a ring of 1.25 inch internal diameter.

In a preferred embodiment of the fabric of the invention the filaments are nylon 6 or 6.6 monofilaments having a mean diameter not greater than 73 μm, a breaking load of from 0.50 to 0.728 lb, a stiffness of 2:1 as herein defined and wherein the fabric is a plain lace net or tulle produced on a bobbinette machine and has a mesh size of the order of 9 meshes per linear cm. and a bursting strength of 41 p.s.i. as herein defined.

The filaments or yarns used in the fabric of the invention possess a combination of fineness and strength not normally encountered in conventional filaments or yarns for textile use. It is principally this combination of the properties of the filamentary elements which determines the nature of the fabrics of the invention, although the fabric structure itself (as determined by the particular order of the interlacing of the filamentary elements) is also a factor.

It is yet another feature of the fabrics of the invention that they combine the characteristics already mentioned, i.e. fineness and strength, with a low degree of obstruction to fluid flow and light penetration, a feature of great importance where the fabrics are to be used as wig or hair-piece foundations. This effect is achieved through the combination of two factors, viz, the large size of the mesh relative to the thickness of the filamentary element and the fact that the thickness is low in absolute terms. The combination makes for a high proportion of "open" area in the fabric. For additionally enhanced light transmission the filamentary elements should also preferably be transparent single filaments (not multifilament yarns whose opacity, especially when twisted, would normally be greater even for comparable overall thickness).

If desired, the filaments may comprise a pigment, dyestuff or matting agent.

As is known, other things being equal, the strength of a filament or fibre is a function of the degree of longitudinal orientation and alignment of the chain molecules (including the case where such molecules are grouped into fibrils), the strength being generally the higher the greater the degree of such alignment. In conventional synthetic filaments the orientation and alignment of the molecules of their constituent polymers is obtained by stretching at the appropriate stage in spinning.

However, it is usually also the case that high degrees of stretch and the resulting alignment are accompanied by increases in stiffness, and in conventional synthetic textile filaments and fibres the degree of stretch imparted is usually a compromise between an acceptable degree of strength, and stiffness low enough not to render difficult the processing of the filaments into yarns and/or fabrics in which processing a degree of flexibility is advantageous.

It has been found that the successful production of open flimsy fabrics from very fine single filament on knitting or lace-making machinery can be difficult, and whilst the difficulties are somewhat alleviated if the filament is stronger than conventional filaments, they are increased with the just-mentioned attendant increase in stiffness. The combined properties of the filaments making up the fabrics according to the invention are such that the filaments (or yarns) can be made up on existing textile machinery so that the advantage of the strength of their constituent filamentary elements can be utilised, even where their stiffness would be regarded as excessively high in conventional terms. The stiffness itself may constitute an additional advantage in some cases as mentioned below.

It is a feature of the mesh fabric of the invention that is can be moulded to produce a substantially permanent shape; this is a particular advantage in the use of the fabric as a wig or hair-piece base or foundation material.

Accordingly the invention also provides a process for the production of a moulded shape from mesh fabric according to the invention which comprises closely applying the fabric to a former at elevated temperature and, if desired, elevated pressure and/or in the presence of a plasticiser to obtain a first moulded shape; this may be further treated with a solution or emulsion of an air and/or heat and/or chemically hardenable polymer and the polymer then hardened.

Where the fabric is to be used as a wig base then the former will be a shape derived from an impression of the area of the scalp to be covered.

Where the fabric is to be used for other purposes, for example as an insect protection screen the former may be a flat platen, or any other desired shape.

In another embodiment of the moulding process of the invention the polymer solution or emulsion may be applied to the fabric before the first moulded shape is produced. This may be in place of or in addition to the later application of the polymer.

The preferred polymer is a cross-linkable acrylic copolymer, for example the product marketed by Rhom & Haas under the trade name "Primal" HA-16. Another suitable material is a cross-linkable methyl silicone derivative polymer or copolymer, for example the product marketed by Midland Silicones Ltd. under the trade name "Silastic" 734. Other suitable polymers will be known to the man skilled in the art.

The general conditions of heat-moulding or setting of mesh fabric according to the invention will be indicated by the appropriate known technology. As an illustration the following type of procedure is useful with the mesh fabric representing the preferred embodiment discussed previously. A piece of mesh fabric is placed over a male former (which may be solid, but may also advantageously consist of metal mesh) and retained firmly but not immovably around the periphery (with a suitable former this may be by means of a jubilee clip). The fabric is then stretched by hand into the closest possible conformity with the former whilst the retaining means are progressively tightened to prevent any "spring back." The fabric and former may then be immersed in water for a period sufficient to ensure thorough wetting, removed and heated at a temperature not exceeding 190° C. for from 10 to 30 minutes, preferably for at least 20 minutes at about 170° C. This treatment sets the fabric to the curved shape of the former. Heating in steam at super-atmospheric pressure can in some cases be used to produce a more permanent set. The general limitations on the severity of conditions for the maximum degree of permanent set will be known to those skilled in the art. As an example, treatment at about 20 p.s.i. gauge pressure for about 20 minutes produces useful results, as does treatment for an appropriately shorter period at about 40 p.s.i. gauge pressure and the corresponding temperature of about 140° C.

Any loss of strength of the fabric resulting from the heat-moulding treatment should preferably not exceed 25% and conditions of time, temperature and pressure from those indicated should be chosen accordingly for the particular fabric being treated.

As stated previously the fabric and the moulding process of the invention are particularly suited to the production of a base or foundation for a wig or hair-piece. This suitability derives from the characteristics of fineness and strength of the fabric and its ability to be moulded by the process described.

Accordingly the present invention provides a process for the production of a wig or hair-piece which comprises taking an impression of the area of the scalp to be covered, forming a male mould from the impression, applying to the male mould a suitably sized piece of the mesh fabric of the invention, shaping the fabric to the male mould under elevated temperature, and if desired elevated pressure to obtain a first moulded shape, if necessary applying to the surface of the first moulded shape a solution or emulsion of an air and/or heat and/or chemically hardenable polymer and hardening the polymer to fix the first moulded shape, knotting one or more natural or synthetic hairs to some or all of the cross-bars of each mesh of the moulded net fabric, applying a coating of the or another solution or emulsion of an air and/or heat and/or chemically hardenable polymer to at least the knots of the hair and, before or after the knotting of the hair, finishing the free edge of the net fabric by providing thereon a band of a non-mesh material and if desired trimming the margin to the line of knotted hair.

The band may be provided in various ways. Where the band is of a thermoplastic material it can be heat welded to the mesh. Alternatively, the band can be bonded to the mesh with a suitable adhesive. Finally, the band can be produced by application of a polymer as defined above and the polymer hardened.

DETAILED DESCRIPTION

Some of the main operations comprising the general process whereby the wig and hair-piece foundations of the invention may be produced, have already been indicated in the foregoing description. A typical version of the complete process may be outlined as follows, it being understood that the order and sequence in which the main operations are mentioned are not rigidly invariant but may be varied, in ways which will be apparent and understandable to those skilled in the art, according to the practical circumstances and the particular embodiment of the general method used.

The impression of the area of the head to which the hair-piece or wig foundation is to be fitted can be taken by one of the known methods employing, for example, stiff adhesive tape. A positive former is then produced, again by one of the well-known techniques (e.g. casting plaster of Paris or an epoxy resin into the female impression previously produced, or by one of the techniques whereby a metal shell former is made by depositing metal into a cavity). Heating means may be incorporated into the former (e.g. steam circulation or electric heating). A piece of mesh fabric as hereinbefore described, cut out oversize in relation to the surface area of the shaping former, is placed over the former and—if extensible—is stretched to the required degree and fastened in the stretched state on the former. One of the factors influencing the extent of stretching in practice will be the final mesh size required. It will be understood that depending on the total amount of stretch to be imparted, the meshes may initially be undersize in relation to those ultimately required in the finished foundation so as to allow for any size increase as a result of the multiaxial stretching on the shaping former. Heat will now be applied, if desired in the presence of water or another plasticiser, via the heating means to fix permanently the shape imparted to the fabric by the shaping former. As has been mentioned, some cross-bonding between individual yarns or filaments of the fabric may be effected at the same time. The heat-shaping operation may be assisted by pressure exerted e.g. against a concave cover more or less accurately shaped and dimensioned in relation to the external (convex) side of the shaping former. Alternatively heating may be carried out, at normal or elevated pressure, in an autoclave.

The first moulded shape so produced may then be fixed and stiffened by applying the polymer solution or emulsion and any necessary treatment (e.g. evaporation of solvent) is carried out in situ. In an alternative embodiment the polymer may be applied before heating the net.

Natural or synthetic hair may then be affixed to the foundation by individual or group knotting in known ways.

As previously described the process of the invention includes the feature of applying to the surface of the wig or hair-piece after the hair has been knotted in a further amount of the polymer solution or emulsion, at least to hair knots. This polymer application anchors the hair knots on to the mesh cross-bars so that the hair cannot rotate about the cross-bar with the result that the natural stiffness of each hair causes it to stand up from the foundation mesh for some distance along its length producing the "spring" evident in natural hair growing from the scalp, a feature not previously attainable in wigs and hair-pieces.

Before or after the hair is knotted in a band of the polymer material is applied to the free edge of the moulded mesh fabric shape to finish the edge and to provide a basis to receive adhesive pads or tape to fix the wig or hair-piece in position on the scalp.

It is preferred that a single natural hair be knotted to each cross-bar of each mesh.

However, in preferred embodiment of the process provided by the invention for the production of wigs and hair-pieces additional particular and novel modifications of the knotting procedures can be used which greatly improve the general appearance of the wig or hair-piece in those respects in which known articles fail to achieve an entirely acceptable standard. It is a common feature of known wigs and hair-pieces that they are produced with a fixed parting which prevents any radical subsequent re-styling of the article due to the fixed position of the parting. It is also usually the case that the "crown" of the wig or hair-piece is positioned artificially at the rear end of the parting which is not where the crown naturally occurs. This fixed artificial relationship in known hair-pieces inevitably results in an unsatisfactory appearance of the crown or the parting or both. The known knotting procedures in the area of the parting and the crown involves the creation of a greater density of hair in the region to form the parting by knotting a hair on each bar of every mesh of the fabric in these areas and extending this region of greater density to a roughly circular area at the rear end of the parting. This circular area is produced by initially knotting in hair to form intersecting diameter lines to define the centre of the area and then covering the area by knotting from the periphery. The crown therefore "radiates" from a central point positioned at the end of the parting, giving an unnatural effect. This method is necessary with known products because of the relatively coarse mesh which has to be used and the presence of an overall lining to the wig or hair-piece.

In the wigs or hair-pieces according to the invention it may be desirable in some cases to incorporate a second or lining layer of the mesh fabric according to the invention. This fabric, being translucent and open does not alter the natural appearance of the product.

Using the mesh fabrics provided by this invention it is possible to obtain an overall density of knotting in linear rows which makes unnecessary the provision of an area of greater density in the parting area and allows of the provision of a "crown" independent of the parting. In the wig-making process of the present invention the crown is independently constructed in its natural position and is produced by knotting in a spiral manner starting from an area outside the point of the crown and winding inwards to finish at the centre of the crown, i.e. in the manner in which the crown grows in natural hair. Finally, in the process of the invention, that area of the front edge of the foundation fabric which is to form the front hair line of the wig or hair-piece can be provided with a lower density of mesh per given area so as to allow the knotting in of a lower density of individual hairs as is the case with natural hair. This lower density of mesh can be achieved by deformation of the mesh in that area or by incorporating a strip of larger mesh material.

Although the mesh fabric of the invention has been described with particular reference to its use as a foundation fabric for wigs and hair-pieces, to which it is particularly suited, the fabric of the invention, because of its unique combination of properties, is suited also for may other purposes.

The combination of strength in the filamentary elements with their fineness makes the fabrics of the invention particularly suitable as filter fabrics, especially if the material of the filamentary elements is a chemically resistant polymer, e.g. nylon or polyester. In some applications stiffness is an additional advantage as is the ability to be formed into a curved shape discussed above. Finally, the small absolute diameter of the filaments means that filters produced from the fabrics according to the invention can have fine meshes down to a mesh size of the order of 100 $\mu$m.

The features of the fabric of the invention which make it also very suitable for the construction of insect-proof enclosures or window screens are essentially those discussed under the previous headings. Stiffness and corrosion resistance which may be associated with a suitable choice of the polymeric material of the filamentary elements make the fabrics in this application particularly attractive in comparison with e.g. metal screens.

Where the fabric is to suffer prolonged exposure to adverse conditions; for example for external use, high temperature, high humidity and high light intensity and humidity may apply, a filament or yarn produced from a stabilised polymer can be used to form the fabric, for example stabilised nylon 6 or 6.6 can be used.

Many other uses for the fabric of the invention can be envisaged, for example as a base fabric for fine quality industrially and hand produced fashion fabrics, for fishing nets, as ornamental and/or protective and display screens.

What I claim is:

1. A novel mesh fabric formed from filaments of a synthetic material having a mean diameter of not greater than 0.11 mm, a breaking load of not less than 0.45 lbs, and a stiffness of at least 3:1 as determined by the loop test, the fabric having a stable mesh structure, a mesh size equal to at least twice the size of the mean diameter of the filament and a bursting strength of not less than 20 p.s.i.

2. A fabric according to claim 1, in which the mesh size is from 6 to 14 meshes per linear centimeter.

3. A novel mesh fabric formed from nylon 6 or 6.6 monofilaments having a mean diameter not greater than 0.073 mm. a breaking load of from 0.50 to 0.728 lb, a stiffness of 2:1 as herein determined by the loop test and wherein the fabric is a bobbinette lace having a mesh size of the order of 9 meshes per linear cm. and a bursting strength of 41 p.s.i. as herein defined.

4. A mesh fabric according to claim 1, in which the filaments comprise an additive selected from the group consisting of pigments, dyestuffs and matting agents.

5. A mesh fabric according to claim 1, wherein the mesh is provided with a coating of an air-hardenable polymer.

* * * * *